United States Patent [19]

Larsen

[11] 4,211,419

[45] Jul. 8, 1980

[54] GAME BOARD AND APPARATUS

[76] Inventor: Russell E. Larsen, 7034 Etiwanda, Apt. #8, Reseda, Calif. 91335

[21] Appl. No.: 857,586

[22] Filed: Dec. 5, 1977

[51] Int. Cl.[2] ..... A63F 3/00

[52] U.S. Cl. ..... 273/248

[58] Field of Search ..... 273/248, 249, DIG. 26, 273/246, 255, 258, 262, 243, 242, 244, 245, 247, 250, 251, 252, 253, 254, 256, 257, 288, 282

[56] References Cited

U.S. PATENT DOCUMENTS

| | | | |
|---|---|---|---|
| 665,123 | 1/1901 | McLoughlin | 273/242 |
| 1,798,701 | 3/1931 | Reed | 273/262 |
| 2,105,837 | 1/1938 | Mayer et al. | 273/260 |
| 2,531,510 | 11/1950 | Heacock | 273/248 X |
| 2,611,616 | 9/1952 | Kloss | 273/243 |
| 4,079,941 | 3/1978 | Morales | 273/260 |
| 4,119,321 | 10/1978 | Creel | 273/248 |
| 4,123,062 | 10/1978 | Wexler et al. | 273/248 |

FOREIGN PATENT DOCUMENTS

| | | | |
|---|---|---|---|
| 276740 | 7/1951 | Switzerland | 273/246 |

*Primary Examiner*—Richard C. Pinkham
*Assistant Examiner*—Scott L. Brown
*Attorney, Agent, or Firm*—Thorpe, North & Gold

[57] ABSTRACT

Game apparatus including a gameboard having an arrangement of pairs of columns, each column pair having its members aligned in opposing orientation and being arranged in side-by-side relation to others pairs of columns, each column being broken into segments for defining movement positions for markers along each column length. A center line divides the gameboard into two opposing sides, with each side having a forward section with segments highlighted to distinguish them from segments of a rearward section. Markers are placed in each segment of the rearward section and forward movement of such markers is initiated by player involvement in drawing a card, spinning a pointer, or throwing dice to determine the player's right to move into the forward section. In a preferred use of the subject game apparatus, the object of play is to locate all of one's markers in the forward section of any given column. By grouping columns into different combinations of side-by-side column arrangements, point values can be assigned for the columns within each group. The gameboard and associated games can be adapted for child level use, or may be utilized for more sophisticated adult players.

18 Claims, 2 Drawing Figures

GAME BOARD AND APPARATUS

BACKGROUND OF THE INVENTION

This invention relates generally to gameboards and more particularly, to gameboards having an arrangement of columns which are segmented to allow movement of a marker along the length of the column.

OBJECTS AND SUMMARY OF THE INVENTION

It is an object of the present invention to provide a game apparatus wherein opposing players move markers along the length of opposing columns.

It is a further object of the present invention to provide game apparatus involving movement of markers along opposing aligned columns wherein each column is divided into at least two sections with an object of the game procedure being the capture or control of certain column sections, and advancement of markers therein.

It is an additional object of this invention to provide a gameboard adapted for the movement of markers along columns thereon, wherein the columns are arranged in side-by-side orientation in groups whose total number of columns correlates to point values assigned to such columns.

It is yet another object of this invention to provide game apparatus utilizing marker movement within columns which is adapted to various skill levels from child through adult.

It is yet another object of this invention to provide a gameboard and apparatus adapted for competitive movement of markers along side-by-side column arrangements on opposing sides of the gameboard wherein an object of the game is to control or capture sections of the column which provide a reward of points.

These and other objects are realized in an invention comprising game apparatus including a gameboard having a side-by-side arrangement of pairs of columns, each pair member being aligned with its corresponding pair member and being separated by a dividing line therebetween. The movement of markers within these respective columns is accomplished by players who utilize opposing sides of the board, each player's movement being restricted to the column pair members on one side of the dividing line.

Each column member is divided into a forward section and a rearward section, with the forward section being positioned in the more proximate location to the dividing line. The forward section is highlighted with heavy lines or other accentuating means to distinguish it from the rearward section of the column members. Each of these sections is further divided into segments which are aligned along the length of the columns and provide placement locations for marker movement thereon. The highlighted appearance of the forward sections facilitate the use of this game with such competitive objects as providing a player with opportunity to move all of his markers from the rearward segments into the forward segments of the column and thereby win the game.

Other objects and features of this invention will be obvious to a person skilled in the art from the detailed description taken with the accompanying drawings, in which.

DETAILED DESCRIPTION OF THE INVENTION

Figure 1:
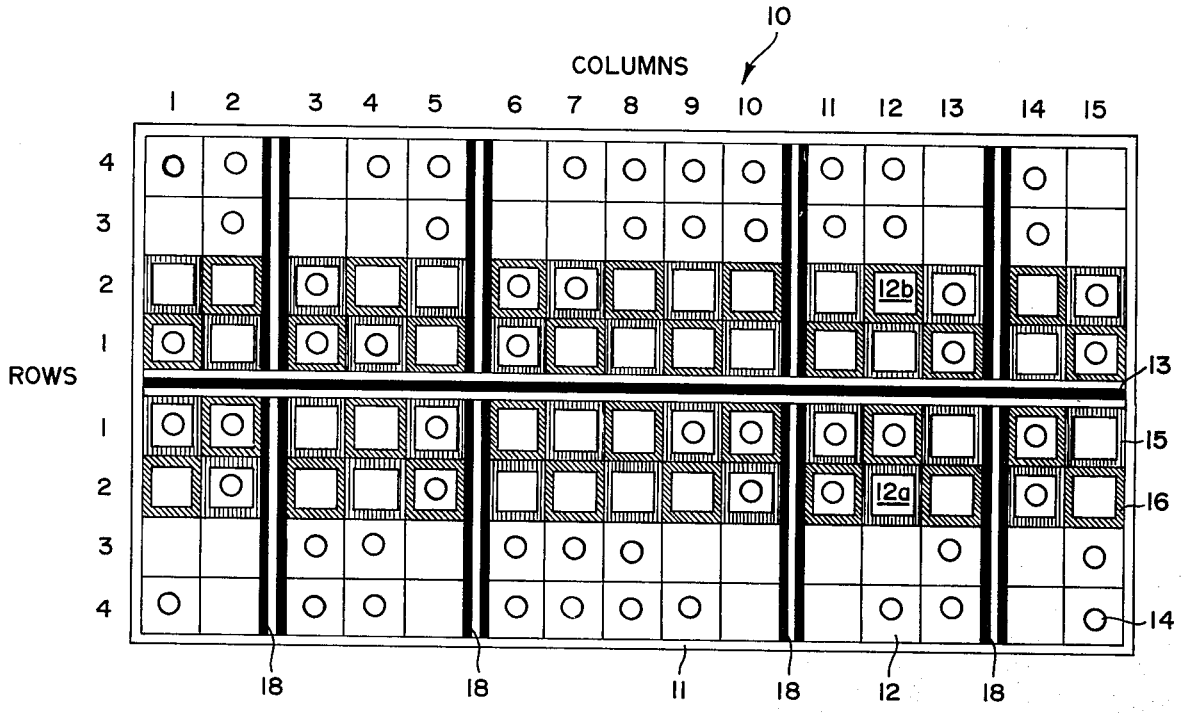
FIG. 1 shows a top view of one embodiment of the gameboard with markers as provided by the present invention.

Referring Now to the Drawings:

One embodiment of the subject gameboard is illustrated in FIG. 1. Referring to that Figure, the gameboard 10 comprises a flat surface 11, having vertical columns 12 oriented in side-by-side location. To facilitate later explanation of game procedures, the columns have been identified at the top of the drawing as Columns 1 through 15. It will be noted that the columns are formed in pairs, each member extending in opposite directions from a common dividing line 13. These respective pairs of columns are aligned on opposing sides of a dividing line because movement of markers in each opposing column forms the basis of competition between the players on opposing sides of the board. For example, movement by one player of markers in column 12*a* will be possibly countered by movement of the opposing player's markers in column 12*b*.

Although the dividing line 13 is shown as a single line traversing the width of the playing board, it is possible for the pairs of columns to be off center and still accomplish the objective of the present invention. This off center orientation of column pairs is enabled because competitive movement by each player occurs only within corresponding column pair members. Therefore, it is not necessary for column 11 to have rows 1, 2, 3 and 4 directly adjacent corresponding row members in column 12.

Each opposing column pair member is divided into two sections. The forward section comprises the rows designated as 1 and 2 on each side of the dividing line 13. The remaining rows 3 and 4 constitute the rearward section, being more remote from the dividing line. Each of these sections is further segmented by dividing the respective sections at right angles along the length of the column. These segments should retain the column aligned structure desired to facilitate movement of markers 14 from the rearward section to the forward section. The inventor has illustrated the segments as squares aligned to form each respective column because of the preferred aesthetic appeal provided by such symmetry. It is obvious that numerous geometrical configurations can be envisioned which will preserve the column aligned structure necessary.

Under a preferred game procedure, the markers 14 of the respective players will be initially placed on the rearward section of each opposing side of the board. In such circumstances, an object of the game may be to move the markers from this rearward location into the forward section. In view of this objective, the forward section segments are highlighted to emphasize the winning position for marker placement. Such highlighting, for example, may be accomplished by the use of accentuating lines having increased thickness as compared to the lines separating the segments of the rearward section. More preferably, these forward segments may be accentuated by color markings around the periphery of each segment. Alternating colors of red 15 and green 16 illustrate the accentuating means for improving aesthetic appeal of the playing board.

Numerous forms of marker means 14 may be utilized in combination with the illustrated gameboard. The round disc configuration illustrated in the drawings is limited in dimensions in accordance with the available space for placement in each segment area. The use of separate colors for each player is preferable to enhance the required segregation of marker means on each opposing side of the board. In addition, color variation of structure variation can be incorporated into the marker means to represent variations in point value or to increase the sophistication or complexity of game procedures.

Figure 2:
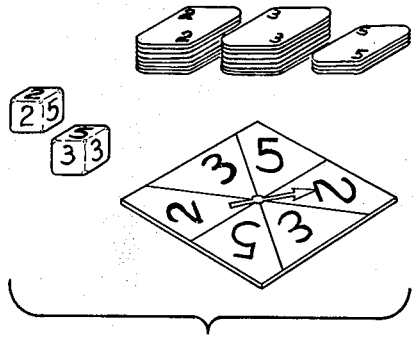
FIG. 2 illustrates different items which may be used to initiate player movement on the gameboard.

In addition to the marker means 14, most applications of the game apparatus will require some means for initiating player movement of his markers. The subject game apparatus is well adapted for numerous types of initiating or hance devices which include dice 21, cards 22, or a spinner assembly 23 as illustrated in FIG. 2. These items may be used singly or in combinations to actuate play on the part of each player. Specific illustrations will be given in later discussion.

As indicated earlier, numerous games can be conformed to the unique arrangement of forward and rearward column aligned segments as disclosed generally above. A further modification can be introduced into the general gameboard layout by grouping pairs of columns in differing numerical combinations. The arrangement illustrated in FIG. 1 shows grouping lines 18 placed in parallel orientation to the respective columns.

Although any variation of number combinations may be useful, the preferred embodiment disclosed herein provides an arrangement of columns grouped in combinations of two, three, five, three and two numerical arrangements. Such grouping designations may be useful in assigning point values to markers moved along columns contained in the respective grouping designations. Column numbers 1, 2, 14 and 15, for example, would identify a point value of two for the markers contained therein. Likewise, with columns 3 through 5 and 11 through 13, the markers positioned thereon would be assigned a point value of 3. In the same pattern, columns 6 through 10 would have a point value of 5.

In addition to point designation, or as an alternative thereto, the numerical designation of the column grouping may serve to identify which marker may be moved forward in response to a number selected by the chance means for initiating movement (FIG. 2). For example, if dice 21 are being utilized as the movement initiating means, a player may cast the dice and move markers in accordance with the numbers rolled during the cast. If the numbers rolled by the dice were 5 and 2, the player may select a marker under the numerical designation of 5 (columns 6 through 10) or 2 (columns 1, 2, 14 and 15) for movement into the forward section. Here again, numerous rules and variations may be adapted to conform to the appropriate level of skill, depending upon the age of the players. Likewise, cards 22 or a spinning device 23 could be utilized to actuate movement of markers based on the explained numerical designation. Furthermore, as mentioned earlier, these devices may be used in combination to increase complexity for use by adults.

As an illustration of an adult game procedure, the following sequence of play is provided:

1. Utilizing an embodiment of the subject gameboard as disclosed in FIG. 1, two players using opposing sides of the gameboard place thirty markers each on the rearward section (rows 3 and 4) of each side of the gameboard.
2. From a stack of point cards having numerical values of two, three and five, each player is given four cards of the two and three point category and two cards of the five point category. These specific point valuations are selected to correspond to the number of columns of a zone or column combination on the gameboard. It will be noted that the point designations of 2, 3 and 5 on the cards correspond to the column groups of two (columns 1, 2, 14 and 15), three (columns 3, 4, 5, 11, 12 and 13), and five columns (columns 6, 7, 8, 9 and 10). These cards are utilized in scoring the game and are each worth the face value shown thereon.
3. The object of the game is to be the first player to move all of his markers from the rearward section of the gameboard to the forward section. When a player has filled any of the respective forward sections of the respective two, three and/or five column groupings before the opposing player fills his corresponding sections, the former player receives from the other player two cards of the same point designation as the sections filled. If the latter player fills his corresponding sections after the opposing player, he is entitled to only one point card having the designation of that particular section filled.
4. A pair of dice are utilized to initiate play for each respective player. The dice rolls are classified into single roll and double roll categories. A single roll occurs when a player rolls differing numbers on each die, such as the 2 and 5 illustrated in FIG. 2. In this case, the player is allowed to advance one marker two spaces forward in either the 2 or 5 sections of the playing board. A double roll results when a player rolls the same number on each die, such as 2 and 2. In this case, the player may advance one marker forward in the two sections and may then roll the dice a second time for a second turn. Alternatively, the player may elect to move one marker into a section not registered on the dice (3 or 5) and thereby forfeit his second dice roll. In each case, markers may be advanced only two spaces forward and must remain within the column of original placement.
5. If either player rolls numbers on the dice representing forward sections which are completely filled, no markers may be advanced and the opposing player can thereupon advance a marker based on the numbers rolled by his opponent. After completing this bonus play, the opposing player then rolls the dice for his own turn.
6. If a player has advanced only one token into the forward section of a given zone and his opponent later advances two markers in the same column onto the latter forward section, the first player having only one marker in the forward section must withdraw that marker into the rearward section.
7. Play continues in the same manner as previously discussed, alternating between each respective player until one player succeeds in placing all thirty markers in the forward section of his side of the gameboard. At that point, each player totals his point value represented by the summation of points represented on his point cards. The player having the highest total points is identified as the winner and is entitled to score the winning points toward winning the match. The losing player is not entitled to score the lesser number of points toward the match game. A match is completed when either player succeeds in reaching 100 points, winning by a 10-point margin.

It will be apparent that numerous variations can be implemented to modify the subject gameboard for use with different age groups. Therefore, it should be understood that the present disclosure is by way of example only and that variations are possible without departing from the scope of the hereinafter claimed subject matter, which subject matter is to be regarded as the invention.

I claim:

1. A game apparatus comprising:

(a) gameboard means having a plurality of pairs of columns, each pair being aligned and having members extending in opposite directions from a center line which separates the corresponding opposing column pair members and defines opposing sides of the gameboard means, at least some of said opposing column pairs being grouped and segregated into side-by-side column combinations having differing numbers of columns, each column being divided into forward and rearward sections relative to said center line, each section being divided into a plurality of column aligned segments, said forward column segments being highlighted so as to be distinguished from said rearward column segments:

(b) a plurality of marker means adapted for emplacement in the column segments, said marker means totaling no more than the total number of forward column segments of the gameboard means; and (c) chance means for initiating movement of said marker means between segments within each respective column, said chance means including a plurality of indicia corresponding to the respective column combinations for selecting marker movement therein.

2. Game apparatus as defined in claim 1, wherein said forward and rearward sections of each column comprise two column segments each.

3. Game apparatus as defined in claim 2, wherein the number of pairs of columns is fifteen and the total number of marker means is sixty.

4. Game apparatus as defined in claim 1, wherein said column combinations have differing numbers of columns selected from the numerical range of two through eight.

5. Game apparatus as defined in claim 4, wherein said column pairs are grouped and segregated into sequential column combinations consisting of 2, 3, 5, 3 and 2 columns each.

6. Game apparatus as defined in claim 4, further comprising a set of scoring cards for use in combination with movement of said marker means.

7. Game apparatus as defined in claim 6, wherein each card is designated with a numerical point valuation corresponding to the numbers selected from said number range of two through eight.

8. Game apparatus as defined in claim 1, wherein said chance means comprises dice, action cards or spinning pointer means mounted on a numbered base member.

9. In a game apparatus, a gameboard comprising a side-by-side arrangement of pairs of columns, at least some of said pairs of columns being grouped and segregated into side-by-side column combinations having differing numbers of columns, each pair member being aligned with its corresponding pair member and being separated therefrom by a dividing line, which dividing line, in combination with other dividing lines for other pairs of columns separates said board into opposing sides for use by opposing players, each column member having a forward section and a rearward section, said forward section being positioned in proximate location to said dividing line and having highlighting means for distinguishing it from the rearward section, each of said sections being further divided into segments in column-like arrangement, said gameboard further comprising chance means for selecting a particular column combination.

10. A gameboard as defined in claim 9, wherein said combination of dividing lines forms a single center line down the middle of said board, separating the opposing sides of said board into substantially equal portions.

11. A gameboard as defined in claim 9, wherein said forward and rearward sections of each column comprise two column segments each.

12. A gameboard as defined in claim 9, wherein said segments are squares having a side dimension substantially equal to the width of the column.

13. A gameboard as defined in claim 9, wherein the highlighting means of the forward section segments comprises accentuating lines defining the periphery of each segment, said accentuating lines having a greater thickness than other periphery defining means for said rearward section segments.

14. A gameboard as defined in claim 9, wherein said accentuating lines are colored.

15. A gameboard as defined in claim 9, wherein some of the pairs of columns are grouped and segregated into side-by-side column combinations having differing numbers of columns selected from the numerical range of two through eight.

16. A gameboard as defined in claim 15, wherein said column pairs are grouped and segregated into column combinations consisting of 2, 3, 5, 3 and 2 columns each.

17. A gameboard as defined in claim 9, further comprising chance means for actuating movement of markers along said columns.

18. A gameboard as defined in claim 17, wherein said chance means comprises a set of action cards having appropriate numbers thereon corresponding to respective column identities.

* * * * *